US005261847A

United States Patent [19]

Cox

[11] Patent Number: 5,261,847

[45] Date of Patent: Nov. 16, 1993

[54] CREATURE FORM WITH REMOVABLE BRUSH

[76] Inventor: Sidnee A. Cox, P.O. Box 1855, Healdsburg, Calif. 95448

[21] Appl. No.: 784,691

[22] Filed: Oct. 30, 1991

[51] Int. Cl.[5] ..... A63H 3/00; A63H 13/02; A63H 3/44; A63H 33/30

[52] U.S. Cl. ..... 446/73; 446/76; 446/296; 446/394; 446/472; 15/176.4; D4/125

[58] Field of Search ..... 446/73, 72, 71, 74, 446/76, 268, 296, 369, 370, 372, 394, 472, 489; 132/142, 147, 148, 120; 15/143 R, 146, 159 R, 176.1, 176.4, 176.5, 176.6; D4/124, 125, 126; D28/63

[56] References Cited

U.S. PATENT DOCUMENTS

| | | | |
|---|---|---|---|
| D. 242,507 | 11/1976 | Cohen et al. | D4/125 |
| D. 281,291 | 11/1985 | Schuler, II | D4/125 X |
| D. 293,123 | 12/1987 | Zidell | 446/369 X |
| D. 315,063 | 3/1991 | Dunlop | D4/125 X |
| D. 316,935 | 5/1991 | Gewen | D4/126 X |
| 2,819,558 | 1/1958 | Freimauer | 446/213 |
| 3,199,139 | 8/1965 | Vallis | 15/176.4 X |
| 4,776,823 | 10/1988 | Hanlon | 446/372 X |
| 4,781,648 | 11/1988 | Garfinkel | 446/369 X |
| 4,787,874 | 11/1988 | Hardy et al. | 446/76 X |
| 5,094,645 | 3/1992 | Stern et al. | 446/370 |

FOREIGN PATENT DOCUMENTS

| | | | |
|---|---|---|---|
| 2411618 | 8/1979 | France | 446/394 |
| 378304 | 8/1932 | United Kingdom | 15/176.4 |
| 480845 | 3/1938 | United Kingdom | 15/176.4 |
| 843013 | 8/1960 | United Kingdom | 15/176.4 |

*Primary Examiner*—Robert A. Hafer
*Assistant Examiner*—D. Neal Muir
*Attorney, Agent, or Firm*—Larry D. Johnson

[57] ABSTRACT

A creature form with a removable brush provides a brush member having a brush head portion bearing a section of outwardly-extending brush bristles, and a brush handle portion, insertable into a creature form having a body portion and a tail simulation portion. The body bears an opening to accommodate the brush head and engage the periphery of the section of brush bristles so that the brush bristles extend outwardly away from the body, and the tail simulation portion bears a cavity to accommodate the brush handle.

7 Claims, 3 Drawing Sheets

CREATURE FORM WITH REMOVABLE BRUSH

BACKGROUND OF THE INVENTION

1. Field of the Invention

This invention relates generally to creature form toys, and particularly concerns a creature form toy which contains a dissimilar object, thereby enabling the creature form toy and contained object to function in a particular way. Specifically, this invention combines a creature form toy with a brush, contained within the creature form body, thereby providing a new type of plaything that offers the flexibility of use as a toy and as a grooming device.

2. Description of the Prior Art

Creature form toys are popular playthings for children and young adults because of their pleasing visual appearance and use in imaginary play. Heretofore, a wide range of creature form toys has appeared on the market. Many are of the stuffed variety, while others are formed from plastic, rubber or similar materials. Often, these creature form toys are combined with certain objects to enable them to perform specific functions, adding to their appeal. There are creature forms with internal adaptations enabling them to walk, talk, sing or play tape recordings. Some creature form toys house flashlights.

In U.S. Pat. No. 4,715,840, which was issued to J. Swift on Dec. 29, 1987, a creature form toy contains a resealable internal pouch, whereby an illumination device, internally housed, lights up the creature form's eyes. This same patent specifies use of its resealable pouch for other purposes, such as retaining baby creature forms in the mother creature form's body, or for storing various items needed for everyday use.

U.S. Pat. No. 4,822,285, issued to S. Summerville on Apr. 18, 1989, makes use of an anatomically stuffed creature form in which removably stuffed organs are housed. The stuffed creature form with removable organs is useful as an educational device, teaching correct anatomical positions of the organs.

Certain other creature forms have been modified to function as slippers for feet, or holders for baby bottles. Likewise, the creature form with removable brush serves a unique function; it is a play toy that can be used as a brush for hair or fur. This invention can appeal to the whimsical nature of many adults and pet owners, but it is especially useful to children, where it can offer them a new type of plaything with the purpose of encouraging grooming.

In as much as the prior art describes a great variety of uses for creature form toys, it shows that there is a continuing need for new and interesting adaptations to creature forms which serve a useful purpose.

The creature form with removable brush is appealing and fun to use, both as a play toy and as a brush for hair or fur. The creature form body lends individuality to the brush, and the protruding brush bristles lend a unique visual feature to the creature form body. The combined objects, the creature form body and the removable brush, can easily be separated for washing of either the body or the brush. Manufacturing of the invention is likewise simplified with the brush and creature form body as separate units.

In the preferred embodiments of the invention, the creature form body can be constructed of a fabric covering with a filler material. It can also be formed from a soft, squeezable plastic or rubber. The intent is to provide a pleasing tactile experience to the person using the invention. A young child may be more inclined to brush his or her hair because of the pleasant feel. A student may want to take the invention to school for use as a comfort object. Whereas the presence of an ordinary toy creature may cause embarrassment, the creature form with removable brush provides a good excuse for the student; it serves a practical purpose as a grooming device.

The creature form body can assume any desired configuration, and be constructed of any appropriate material formed to the desired shape. Therefore, the embodiments described herein are not intended to be limiting, but rather illustrative with respect to the scope of the invention. Whereas, the creature form body is capable of numerous variations, likewise is the contained brush capable of varying styles. Again, it is to be understood that the present invention and separate elements thereof, can assume any desired shape, and are not limited to the descriptions and illustrations of the preferred embodiments described herein.

Further objects and advantages will become apparent from the following summary of the invention.

SUMMARY OF THE INVENTION

The creature form with removable brush consists of a creature form toy with an opening, which contains a removable brush useful for hair or fur. The creature form and removable brush function together as a plaything and as a grooming device.

The brush is contained within the opening on the back or underside of the creature form. Some embodiments contain a brush with a handle, in which case the handle extends internally down the length of the body. The head of the brush remains uncovered, with bristles protruding outward from the body.

The brush bristles provide an important design element to the appearance of the creature form. In the case of the fish and marine mammal embodiments, the bristles simulate spines or fins on the creature's back. In the case of the porcupine embodiment, the brush bristles simulate quills on the back. The centipede embodiment makes use of the bristles to simulate legs on the underside of the body. As previously mentioned, the creature form with removable brush can assume many forms, as desired, and is not limited to the embodiments shown and described in this application.

The creature form body can be constructed from a fabric covering stuffed with a filler material. Means for securing the brush head within the stuffed fabric body consist of a stretchable material, such as elastic cord or the like, connected to the rim of the opening by some convenient method. In the preferred embodiments, the elastic cord is connected to the rim by insertion into a seam, surrounding the opening.

The creature form body can also be made from a molded material, such as plastic or a rubber-like substance. Means for securing the brush head within the molded creature form body consist of a lip and shelf, connected to the rim and interior sides of the opening, respectively. The lip and shelf may be part of the same mold as is used to form the body. The back of the brush head rests on the shelf, and the lip on the rim of the opening holds the brush head firmly in place. With regard to the preferred embodiment, the lip completely surrounds the opening, and the shelf partially encircles the interior thereof, with a space allowing for passage of the brush handle to extend down the length of the body.

Another means for securing the brush head within the molded creature form body consist of a lip and platform design. The platform is connected to the interior sides of the opening, enclosing the space within the body. The back of the brush head rests upon the platform, and with lip, surrounding the rim of the opening, holds the brush head firmly in place. A brush head without an adjoining handle is appropriate for use with the lip and platform design. The body and connected lip and platform may be part of the same mold.

A contoured hole, shaped in such a way as to enable the body to squeak with applied pressure, may be inserted into the molded creature form body.

Again, it is to be understood that the invention is not limited to the details of construction and materials used, or to the styles and forms set forth herein. The invention is capable of many embodiments, and can be constructed in various ways.

Having thus summarized the invention, a clearer understanding of the creature form with removable brush can be realized by a consideration of the following illustrations and detailed descriptions thereof.

Drawing Reference Numerals

Figure 1:
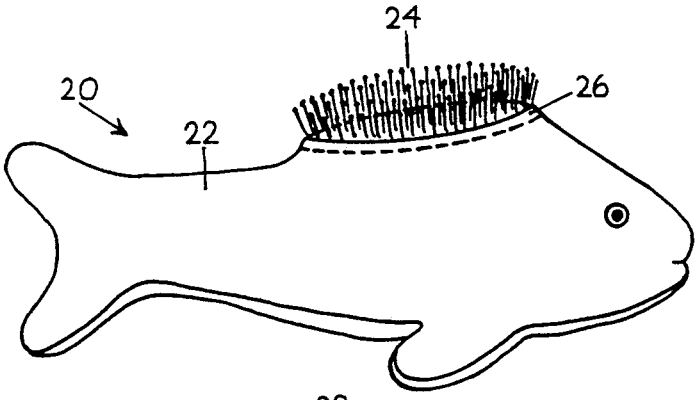
FIG. 1 is a side view of the creature form with removable brush representing a first embodiment of the invention.

20 fish creature form with removable brush
22 fish shaped body
24 brush head with bristles
25 brush handle
26 seam in body 22
28 opening in body 22
30 underside portion of body 22
32 porcupine creature form with removable brush
34 porcupine shaped body
36 seam in body 34
38 centipede creature form with removable brush
40 centipede shaped body
42 seam in body 40
44 killer whale creature form with removable brush
46 killer whale shaped body
48 opening in body 46
50 lip of body 46
51 shelf in opening 48
52 gap in shelf 51
54 molded four-legged creature form with removable brush
56 molded four legged creature form body
58 lip of body 56
59 platform in body 56
60 contoured hole in body 56

DETAILED DESCRIPTION OF A PREFERRED EMBODIMENT

Referring now to the drawings, and in particular to FIG. 1 thereof, there is shown a creature form with removable brush 20, incorporating a first embodiment of the invention. The creature form with removable brush 20 comprises a body 22 which simulates, in shape, the form of a creature such as a fish. A brush, consisting of a brush head with bristles and a handle (not shown), is housed within body 22, bristles protruding outwardly therefrom. The body 22 is formed from a fabric covering stuffed with a filler material. A means for securing brush head 24 within body 22 is provided by a stretchable material, such as elastic cord or the like, attached to the body by insertion into a seam 26, encircling the bristles.

Figure 2:
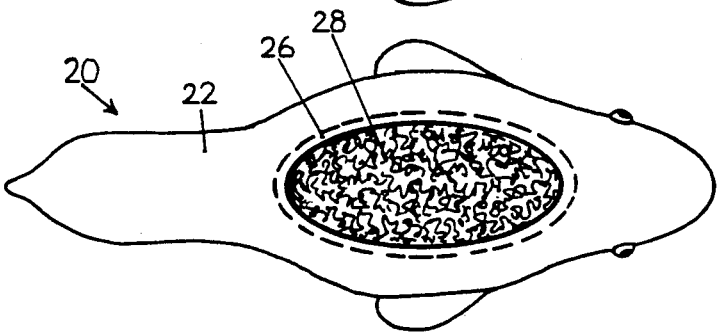
FIG. 2 is a top view of the creature form without the removable brush representing a first embodiment of the invention.

FIG. 2 is a top view of the first embodiment 20, showing the body 22 without the removable brush. Seam 26 with inserted stretchable material surrounds an opening 28. Shown within the opening 28 is a filler material used for stuffing the body 22. A panel of material may be used to cover the inside of the opening, in which case the filler material would not be visible when the brush is removed.

Figure 3:
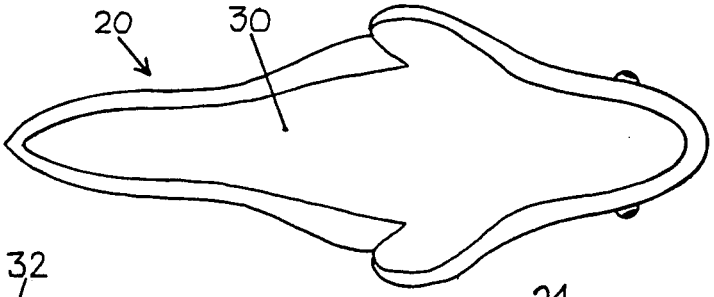
FIG. 3 is a bottom view of the creature form with removable brush representing a first embodiment of the invention.

FIG. 3 illustrates a bottom view of the first embodiment 20, showing the underside portion 30 of the body 22. The underside portion 30 is completely enclosed.

Figure 5:
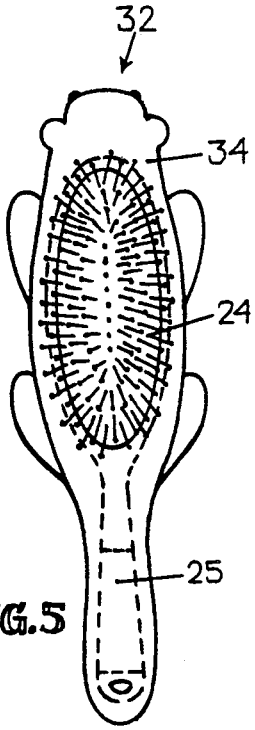
FIG. 5 is a top view of the creature form with removable brush representing a second embodiment of the invention.
Figure 4:
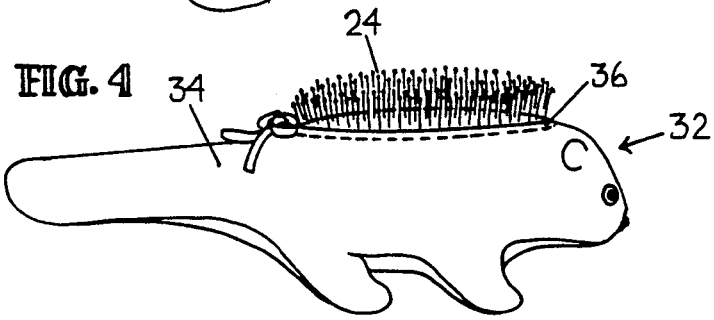
FIG. 4 is a side view of the creature form with removable brush representing a second embodiment of the invention.

FIG. 4 and 5 illustrate the second embodiment of the invention, which is similar to the first except that it simulates, in shape, a four-legged creature such as a porcupine. The porcupine embodiment 32 is comprised of a body 34 and a contained removable brush, which consists of a brush head with bristles 24 and a handle 25. Also similar to the first embodiment is the securing means for holding brush 24 within body 34 by the use of a stretchable material sewn into a seam 36. Positioning of the brush head 24 with handle 25 within body 344 is best illustrated in FIG. 5, showing a top view of the second embodiment, in which the brush handle 25 extends internally down the tail portion of the body.

Figure 6:
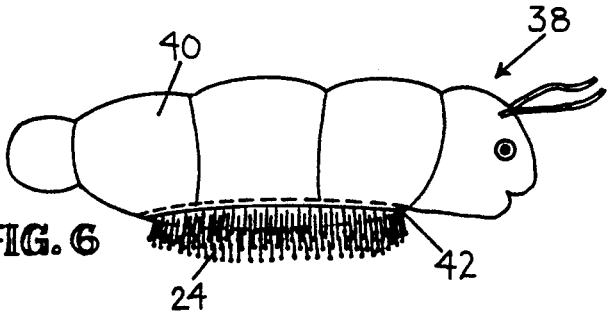
FIG. 6 is a side view of the creature form with removable brush representing a third embodiment of the invention.

FIG. 6 illustrates the third embodiment of the invention 38 which is similar to the first and second embodiments, except that it simulates, in shape, the form of an insect such as a centipede. This third embodiment is comprised of a body 40 with a contained removable brush, consisting of a brush head with bristles 24 and a handle (not shown), shortened to fit the abbreviated centipede body. Brush head 24 is received within an opening located on the underside of the body 40. Once again, securing means for holding the brush 24 within the body 40 is provided by a stretchable material inserted into seam 42, encircling the bristles.

It is to be understood that many different sizes and styles of brushes may be used for insertion into the creature form bodies. Likewise, it is not the intention of this application to specify the containment of a certain size or style of brush. However, due to the configuration of the various embodiments, certain sizes and styles of brushes are considered more appropriate than others, as indicated herein.

Figure 7:
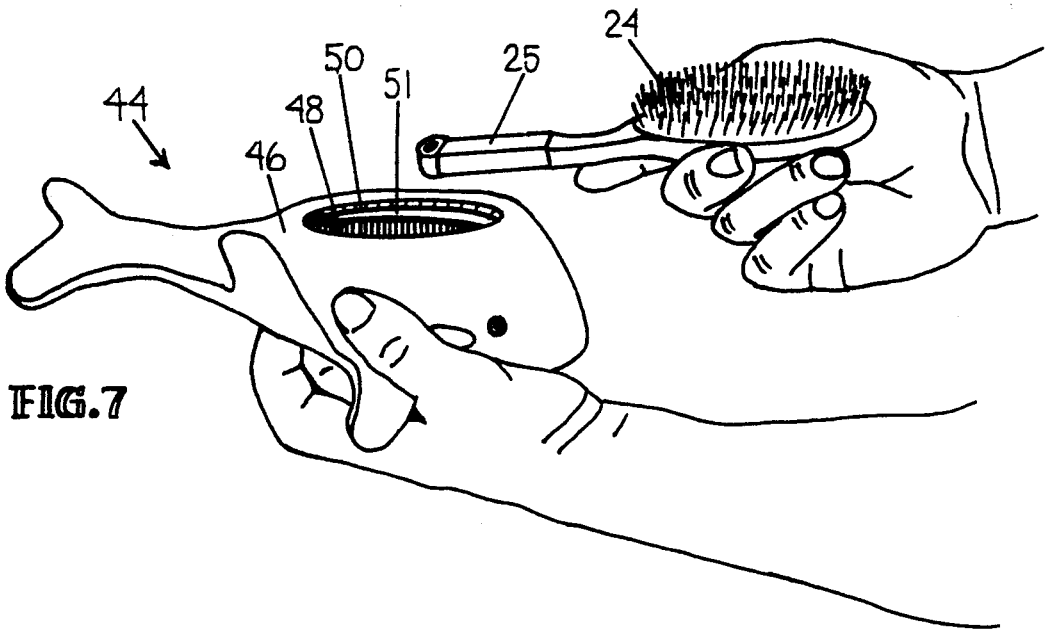
FIG. 7 is a perspective view of a fourth embodiment of the invention showing the separate elements, creature form body and brush, before insertion of the brush into the body.
Figure 8:
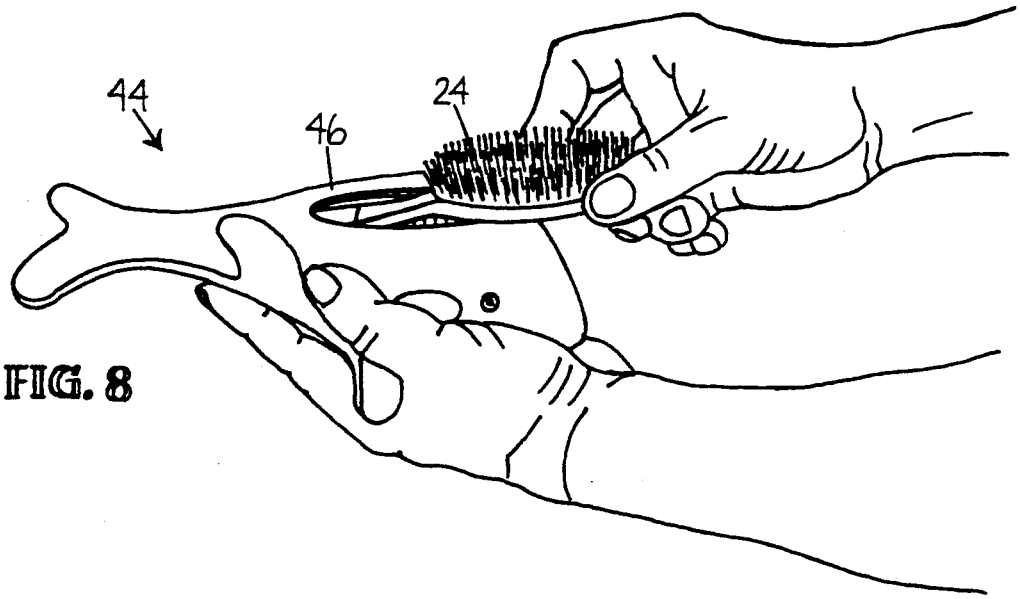
FIG. 8 is a perspective view of the fourth embodiment of the invention showing the brush in the process of being inserted into the creature form body.
Figure 9:
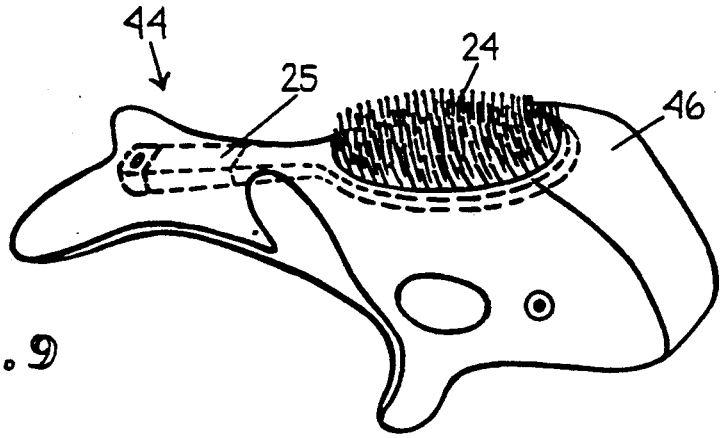
FIG. 9 is a perspective view of the fourth embodiment of the invention showing the placement of the brush after insertion into the creature form body.

Referring now to FIGS. 7–9 thereof, there is shown a fourth embodiment of the invention 44, consisting of a creature form body 46, in the configuration of a marine mammal, specifically a killer whale. Also shown is a brush, comprised of a brush had with bristles 24 and a brush handle 25, during three consecutive stages of insertion into body 46. The material used to form body 46 has an opening 48 for the purpose of housing brush head 24. Means for securing the brush head 24 within the opening 48 is provided by a lip 50 and a shelf 51. Brush handle 25 slips down the tail portion of body 46 as shown in FIG. 8. Once inserted, the back of the brush head rests on the shelf 51, and the lip 50 holds the brush head firmly in place around the bristles. FIG. 9 shows the completed form of the fourth embodiment 44, depicting the brush head 24 with handle 25 internally housed within body 46.

Figure 10:
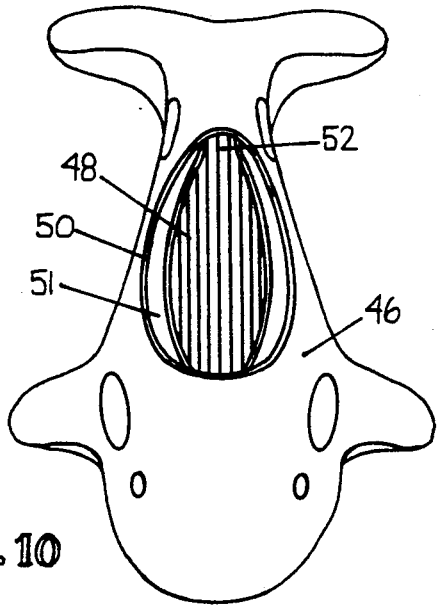
FIG. 10 is a top frontal view of the fourth embodiment of the invention showing the creature form without the removable brush.
Figure 11:
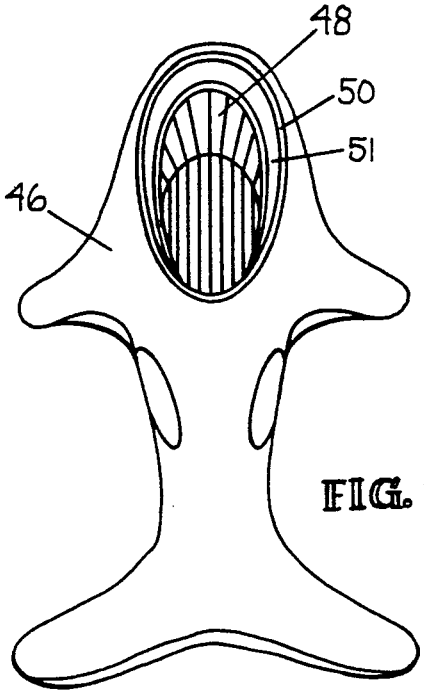
FIG. 11 is a top rear view of the fourth embodiment of the invention showing the creature form without the removable brush.

FIGS. 10–11 further illustrate the fourth embodiment of the invention, consisting of the body in the shape of the killer whale without the removable brush. FIG. 10 shows the body 46, as viewed from the top, looking from the front toward the rear of the body. The lip 50 surrounds the rim of the opening 48, and the shelf 51, located within the opening, partially encircles the interior thereof. The gap 52 in the shelf 51 allows for the passage of the brush handle to extend down the tail portion. FIG. 11 illustrates the body 46 from the top, looking from the rear toward the front of the body, providing a different view of opening 48, lip 50 and shelf 51.

Figure 12:
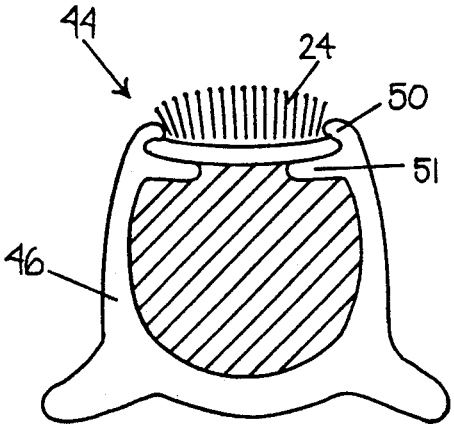
FIG. 12 is a frontal cross sectional view of the fourth embodiment of the creature form with removable brush.

FIG. 12 is a frontal, cross sectional view of the fourth embodiment 44, which also simulates, in shape, the body of the killer whale. The removable brush, contained within the body 46, consists of the brush head with bristles 24 and a handle (not shown). Depicted is the relative positioning of the lip 50 and the shelf 51 as they function to hold the brush head in place. Interior space of body 46 is hollow.

Figure 13:
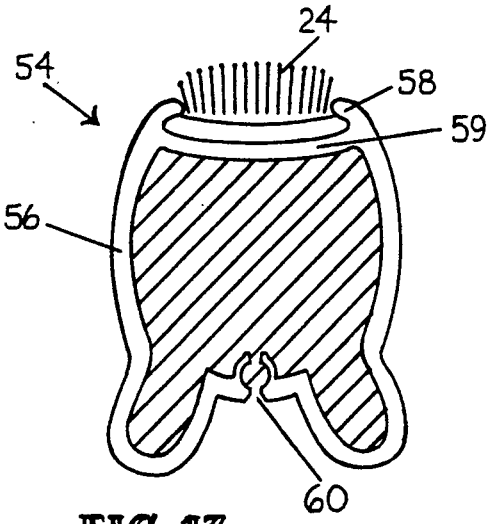
FIG. 13 is a frontal cross sectional view of a fifth embodiment of the creature form with removable brush.

FIG. 13 illustrates a fifth embodiment of the invention 54, showing a frontal, cross sectional view of a four-legged creature form with removable brush. The body 56 is formed from a molded material similar to that which was used to form the fourth and fifth embodiments. The head with bristles 24 and has no handle. The brush head 24 is contained within the body 56 by a securing method consisting of a lip 58 and a platform 59. The platform 59 is connected to the interior sides of the opening, completely enclosing the space within, and the brush head 24 rests upon platform 59. The lip 58 holds the brush head firmly in place. A contoured hole 60 is located in the underside of body 56, enabling the creature form to make a squeaking noise when pressure is applied to the body.

With respect to the aforementioned descriptions, it is to be understood that the various embodiments and specific adaptations described herein are for illustrative purposes only. As previously mentioned, the creature form with removable brush is capable of numerous variations. It is therefore requested that the scope of the invention be measured by the following claims, and not be the specific examples provided herein.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed is:

1. A creature form with removable brush comprising:
a brush member having a brush head portion bearing a section of outwardly-extending brush bristles, and a brush handle portion; and
a creature form having a body portion with head, appendages and a tail simulation portions, said body portion bearing an opening accommodating said brush head portion and engaging the periphery of said section of brush bristles so that said brush bristles extend outwardly away from said body portion, and said tail simulation portion bearing a cavity accommodating and enclosing said brush handle portion.

2. The creature form with removable brush of claim 1 wherein said body portion comprises a fabric covering filled with a stuffing material.

3. The creature form with removable brush of claim 1 wherein said body portion opening comprises a stretchable material connected to the rim of said opening.

4. The creature form with removable brush of claim 1 wherein said body portion comprises a molded material.

5. The creature form with removable brush of claim 1 wherein said body portion opening comprises a lip and a shelf, connected to the rim and interior sides of said opening, respectively.

6. The creature form with removable brush of claim 1 wherein said body portion opening comprises a lip and a platform, said lip connected to the rim of said opening and said platform connected to the interior sides of said opening, enclosing the space underneath said brush head portion.

7. The creature form with removable brush of claim 1, further including a hole in said body portion contoured to enable the body to produce a squeaking sound when pressure is applied to said body.

* * * * *